United States Patent [19]

Miserez

[11] 4,453,310

[45] Jun. 12, 1984

[54] RAZOR WITH SLIDING COVER HAVING INTEGRAL ACTUATOR

[75] Inventor: Claude L. Miserez, Watertown, Conn.

[73] Assignee: Warner-Lambert Company, Morris Plains, N.J.

[21] Appl. No.: 362,809

[22] Filed: Mar. 29, 1982

[51] Int. Cl.[3] ..... B26B 21/06

[52] U.S. Cl. ..... 30/47; 30/84

[58] Field of Search ..... 30/32, 47, 84, 77, 79

[56] References Cited

U.S. PATENT DOCUMENTS

| | | | |
|---|---|---|---|
| 2,154,581 | 4/1939 | Pershall | 222/473 |
| 2,744,319 | 5/1956 | Cutler | 30/84 X |
| 3,028,034 | 4/1962 | Freiman | 222/472 |
| 4,265,015 | 5/1981 | Asano | 30/47 X |
| 4,300,285 | 11/1981 | Endo | 30/47 |
| 4,328,615 | 5/1982 | Bowman et al. | 30/47 X |

*Primary Examiner*—Jimmy C. Peters

*Attorney, Agent, or Firm*—R. S. Strickler

[57] ABSTRACT

A disposable razor having a sliding cover for protecting and exposing blade edges, selectively, with a manually operable cover actuator molded integrally with the cover.

5 Claims, 6 Drawing Figures

FIG.5
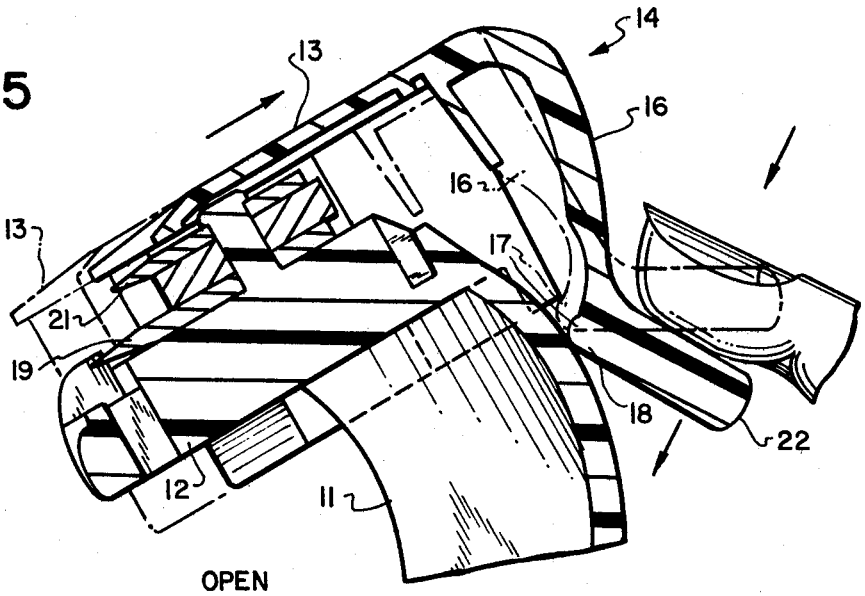
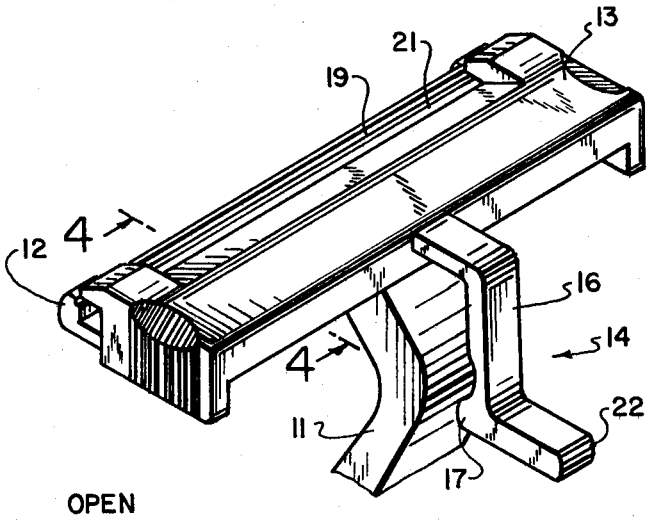
FIG.3

CLOSED

OPEN

RAZOR WITH SLIDING COVER HAVING INTEGRAL ACTUATOR

BACKGROUND OF THE INVENTION

The present invention relates to disposable razors and relates in particular to razors of this class which are fitted with a movable, permanently attached blade cover which is movable selectively to expose or cover razor blade edges as desired.

Representative embodiments of razors over which this invention is an improvement are disclosed and claimed in copending U.S. Patent Applications Ser. No. 108,747 by Bowman et al. filed Dec. 31, 1979, now U.S. Pat. No. 4,328,615, Ser. No. 275,475 by Chen filed June 19, 1981, and Ser. No. 332,986 by Byrne filed Dec. 21, 1981.

The '747 application shows a cover 14 which makes a permanent but sliding connection with a blade support or seat 18 which is movable from a closed position in which blade edges are protected to an open position in which the blade edges are exposed properly for wet shaving.

The '475 application shows a cover 14 making a similar connection with a razor body or blade support. Its distinguishing feature is a lever system supported pivotally in the razor handle and makes a driving connection with the cover so that the cover is movable from the closed to the open position by manipulation of the lever in "one-hand" fashion.

The '986 application shows an improved cover manipulator in the form of a slide or actuator 21 mounted in a track 17 in the razor handle. The slide makes a flexible connection with the cover so that motion of the slide along the track moves the cover along its track.

The use of the terms "blade", "blade package", "blade edge" or "blade cutting edges" in this specification is intended to include one or more blades each having a single cutting edge.

A particular feature of the present invention is the provision of a sliding permanently attached blade cover which includes a cover actuating lever molded integrally with the cover to define with the cover a single piece-part.

A further feature of the invention is the provision of a razor of the above configuration including a handle where the lever is formed with a rocker arm or "walking" pivot operable to find a fulcrum upon and "walk" along the razor handle.

A further feature of the invention is the provision of a disposable razor having a sliding cover including a cover actuator which is of uncomplicated design and which is complementary to high-speed mass production, systems necessary to achieve commercial success in the disposable razor market.

SUMMARY OF THE INVENTION

A razor embodying certain features of the present invention may comprise a razor body including a handle, a blade package supported in the body, a cover attached permanently to and slidable along the razor body and a lever or actuator formed integrally with the cover, said handle providing a fulcrum for the lever for actuating the cover in "one-hand" fashion by manipulation of the lever about said fulcrum.

Other features and advantages of the present invention will become more apparent from a reference to the succeeding specification when read in conjunction with the appended drawings.

BRIEF DESCRIPTION OF THE DRAWINGS

FIG. 3, in perspective, is similar to FIG. 2 showing the cover in the open or operative position;

FIG. 5 is similar to FIG. 4 showing the cover actuator in the operative position and the cover "open" with the blade package exposed preperly for wet shaving.

DESCRIPTION OF PREFERRED EMBODIMENT

Figure 1:
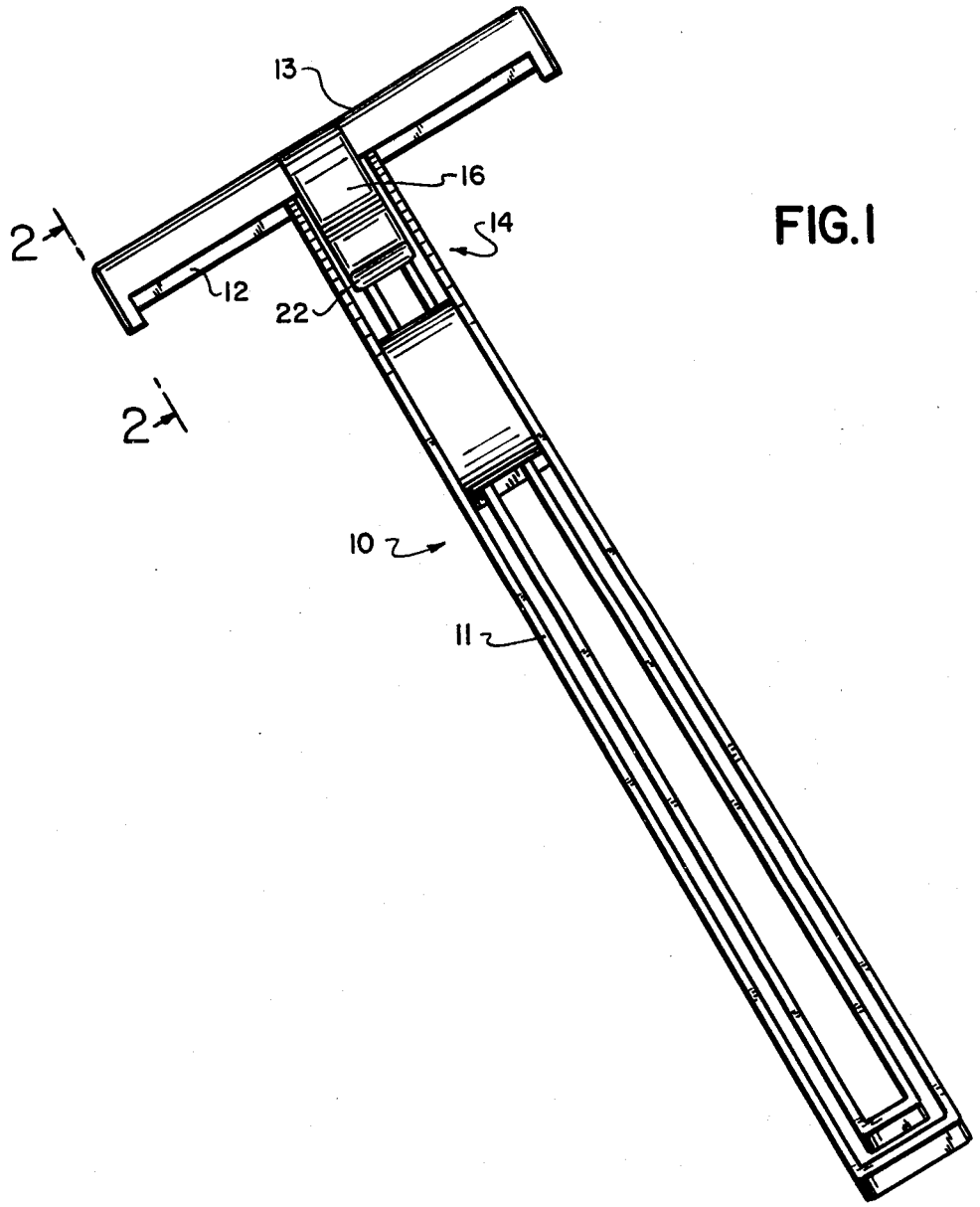
FIG. 1 is a perspective view of the back side of a low cost disposable razor illustrating the invention.

Referring now to the drawings, the reference numeral 10 designated a low cost disposable razor having a handle 11, a blade support or razor body 12, a sliding blade cover or cap 13 and a cover actuator 14.

Figure 2:
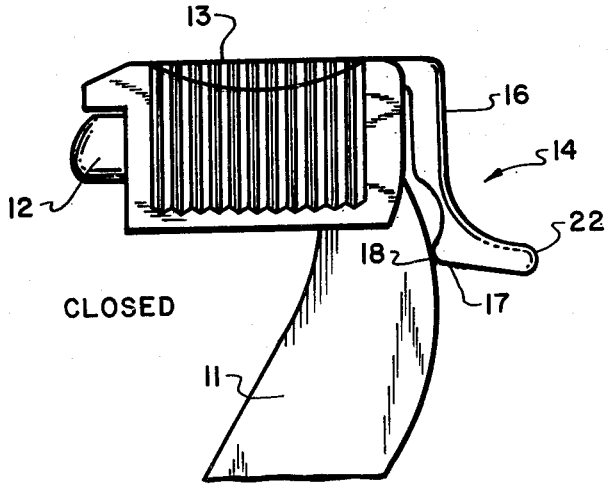
FIG. 2 is a side view of a portion of the razor of FIG. 1 as viewed in the plane represented by the line 2—2 and in the direction of the arrows showing the blade cover in the closed position.

The exterior side view of the razor in FIG. 2 shows the cover 13 with integrally attached actuator 14 defining a lever 16 and "walking" rocker arm or pivot 17 in contact with the handle 11 at 18. The illustration of FIG. 2 shows the cover 13 in the "closed" position (blades protected) and the handle 11 providing a fulcrum for the lever.

Figure 4:
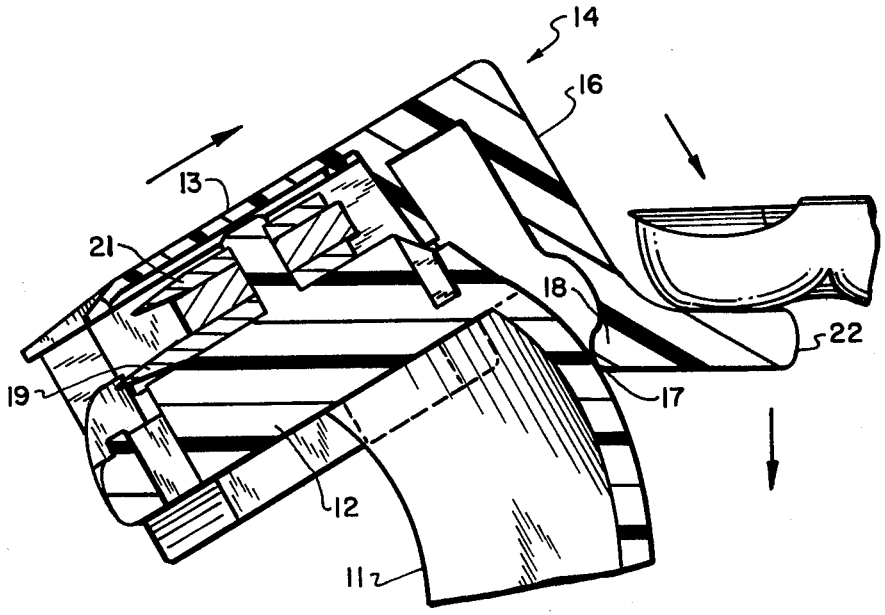
FIG. 4 is a vertical section of FIG. 3 as viewed in the plane represented by the line 4—4 showing the disposition of razor elements, in detail, when the razor unit is closed.
Figure 6:
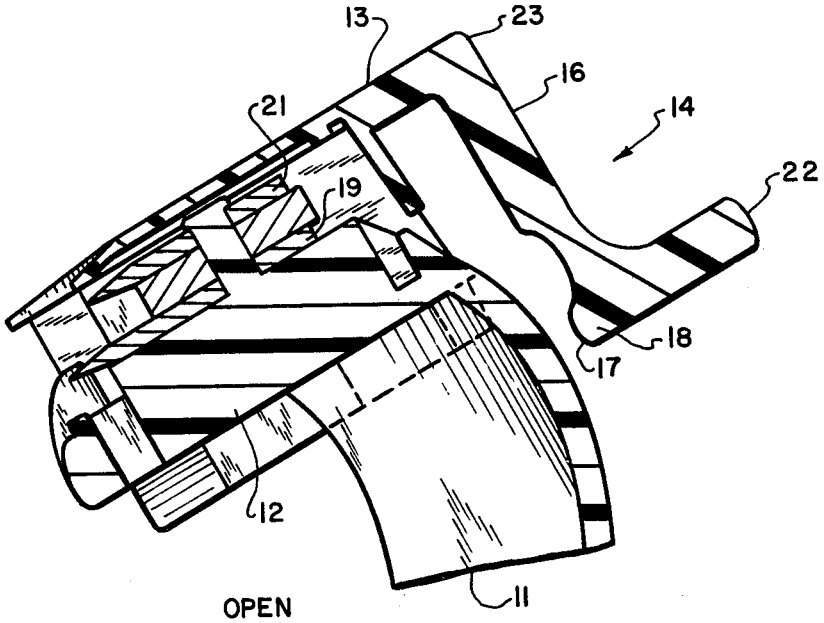
FIG. 6 is similar to FIG. 5 showing the cover in the open position with the actuator in the "relaxed" position.

FIG. 3 shows the cover "open" with the blade edges 19 and 21 exposed properly for wet shaving. Note that the lever 16 is in a "relaxed" condition and the arm or pivot 17 is spaced from the handle 11. (See also FIG. 6.) FIGS. 4 through 6 show the disposition of piece-parts in the closed, open, and relaxed positions in greater detail.

In FIG. 4, the cover 13 is closed and blade edges 19 and 21 are protected.

Arm 17 is in contact with handle 11 with operating tab 22 of lever 16 poised for manual depression (rotation) in the direction indicated by the arrows.

FIG. 5 shows (in solid lines) the disposition of razor elements immediately after manual depression or rotation of tab 22 with the razor open and the blade edges properly exposed for wet shaving.

Note that the arm 17, in finding a fulcrum upon handle 11, has also "walked" down the handle a distance represented by the space between the fulcrum point at the closed position (dotted line) and the fulcrum point at the open position (solid line).

FIG. 6 shows the razor open and the cover actuator 14 relaxed in that the lever 16 and the arm 17, by virtue of the elastic memory of the material from which the cover-actuator piece-part was fabricated, are spaced from the handle 11.

OPERATION

Assuming that the cover 13 is in the closed position of FIG. 4, depression of tab 22 will cause arm 17 to rotate about handle 11 with the result that lever 16 moves cover 13 in the direction of arrow to the open position as shown in FIG. 5 to expose blades 19 and 21 properly for wet shaving.

During the manipulation of the tab 22 about the handle 11, the fulcrum about which arm 17 rotates tends to migrate a short distance along the handle usually in a downward direction from the dotted line position of FIG. 5 to the solid line position thereof.

Upon release of the tab 22, the lever 16 assumes a relaxed position as disclosed in FIG. 6.

When it is desired to close the razor, one merely applies pressure with an appropriate digit (manually) at the point indicated by the reference numeral 23 of FIG. 6 to move the cover 13 to the closed position, i.e., until the arm 17 abuts the handle 11.

It is to be noted that the manipulation of the cover 13 (opening and closing) by means of the present invention is accomplished in "one-hand" fashion.

What is claimed is:

1. In a disposable razor including a blade package and a handle of the type having a permanently connected sliding blade cover operable to protect and expose the blade package selectively, the improvement comprising:

a cover actuator molded integrally with the cover defining with the cover a single piece-part, an element of said actuator being normally in contact with said handle while said blade package is protected by said cover, said handle providing a fulcrum for said element, said actuator and said element being operable to rotate about said fulcrum and move or walk along said handle to develop sufficient mechanical advantage to move the cover to expose the blade package for wet shaving, said actuator being flexible relative to said cover and having sufficient elastic memory to be operable to move out of contact with said fulcrum after said blade package is exposed for shaving.

2. The razor of claim 1 in which the cover actuator defines a lever and a rocker arm, said rocker arm being in contact with said handle when the blade cover is protecting the blade package.

3. The razor of claim 2 in which the cover actuator is formed with an operating tab.

4. In a disposable razor including a blade package and a handle of the type having a permanently connected sliding blade cover operable to protect and expose the blade package selectively, the improvement comprising:

a lever molded integrally with the cover defining with the cover a single piece-part, said lever being molded with a rocker arm normally in releasable contact with said handle while said blade package is protected by said cover, said lever being flexible relative to said cover and operable to rotate about and to travel along said handle developing sufficient mechanical advantage to move the lever and thus the cover to expose the blade package for wet shaving.

5. In a disposable razor including a blade package and a handle of the type having a permanently connected sliding blade cover operable to protect and expose the blade package selectively, the improvement comprising:

a lever formed integrally with the cover defining with the cover a single piece-part, said lever being formed with a rocker arm normally in contact with said handle defining a fulcrum while said blade package is protected, said lever being flexible relative to said cover and being further formed with a manually operable tab depressible to rotate said rocker arm about said fulcrum and along said handle to develop sufficient mechanical advantage to move the lever and thus the cover to expose the blade package for wet shaving, after exposure of the blade package and after release of the tab the lever, by virtue of its inherent elastic memory, being operable to move out of contact with the handle automatically.

* * * * *